US007666012B2

(12) United States Patent
Hughes et al.

(10) Patent No.: US 7,666,012 B2
(45) Date of Patent: Feb. 23, 2010

(54) SEPARABLE LOADBREAK CONNECTOR FOR MAKING OR BREAKING AN ENERGIZED CONNECTION IN A POWER DISTRIBUTION NETWORK

(75) Inventors: David Charles Hughes, Rubicon, WI (US); Paul Michael Roscizewski, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/688,673

(22) Filed: Mar. 20, 2007

(65) Prior Publication Data

US 2008/0233786 A1 Sep. 25, 2008

(51) Int. Cl.
*H01R 13/53* (2006.01)

(52) U.S. Cl. ..... 439/181

(58) Field of Classification Search ..... 439/181, 439/182, 183, 184, 185, 186; 218/90; 251/31
See application file for complete search history.

(56) References Cited

U.S. PATENT DOCUMENTS

| | | | | |
|---|---|---|---|---|
| 1,903,956 | A | | 4/1933 | Christie et al. |
| 2,953,724 | A | | 9/1960 | Hilfiker et al. |
| 3,115,329 | A | * | 12/1963 | Wing et al. ..... 251/31 |
| 3,392,363 | A | | 7/1968 | Geis, Jr. et al. |
| 3,471,669 | A | | 10/1969 | Curtis |
| 3,474,386 | A | | 10/1969 | Link |
| 3,509,516 | A | | 4/1970 | Phillips |
| 3,509,518 | A | | 4/1970 | Phillips |
| 3,513,425 | A | | 5/1970 | Arndt |
| 3,539,972 | A | | 11/1970 | Silva et al. |
| 3,542,986 | A | * | 11/1970 | Kotski ..... 218/90 |
| 3,546,535 | A | | 12/1970 | Van Riemsdijk |
| 3,576,493 | A | | 4/1971 | Tachick et al. |
| 3,594,685 | A | | 7/1971 | Cunningham |
| 3,652,975 | A | | 3/1972 | Keto |
| 3,654,590 | A | | 4/1972 | Brown |
| 3,663,928 | A | | 5/1972 | Keto |
| 3,670,287 | A | | 6/1972 | Keto |
| 3,678,432 | A | | 7/1972 | Boliver |
| 3,720,904 | A | | 3/1973 | De Sio |
| 3,725,846 | A | | 4/1973 | Strain |
| 3,740,503 | A | | 6/1973 | Tomohiro et al. |
| 3,740,511 | A | | 6/1973 | Westmoreland |
| 3,798,586 | A | | 3/1974 | Huska |
| 3,826,860 | A | | 7/1974 | De Sio et al. |
| 3,845,233 | A | | 10/1974 | Burton |
| 3,860,322 | A | | 1/1975 | Sankey et al. |

(Continued)

FOREIGN PATENT DOCUMENTS

| | | |
|---|---|---|
| DE | 3110609 | 10/1982 |

(Continued)

OTHER PUBLICATIONS

U.S. Appl. No. 11/809,508, Hughes et. al.

(Continued)

*Primary Examiner*—Chandrika Prasad
(74) *Attorney, Agent, or Firm*—King & Spalding LLP

(57) ABSTRACT

Separable loadbreak connectors include an interference element spaced about the contact tube that is configured to engage a portion of a connector piston.

13 Claims, 5 Drawing Sheets

U.S. PATENT DOCUMENTS

| | | | | |
|---|---|---|---|---|
| 3,915,534 | A | | 10/1975 | Yonkers |
| 3,924,914 | A | | 12/1975 | Banner |
| 3,945,699 | A | | 3/1976 | Westrom |
| 3,949,343 | A | | 4/1976 | Yonkers |
| 3,953,099 | A | | 4/1976 | Wilson |
| 3,955,874 | A | | 5/1976 | Boliver |
| 3,957,332 | A | | 5/1976 | Lambert, III |
| 3,960,433 | A | | 6/1976 | Boliver |
| 4,029,380 | A | | 6/1977 | Yonkers |
| 4,040,696 | A | | 8/1977 | Wada et al. |
| 4,067,636 | A | | 1/1978 | Boliver et al. |
| 4,088,383 | A | | 5/1978 | Fischer et al. |
| 4,102,608 | A | * | 7/1978 | Balkau et al. ..... 417/242 |
| 4,103,123 | A | | 7/1978 | Marquardt |
| 4,107,486 | A | | 8/1978 | Evans |
| 4,113,339 | A | | 9/1978 | Eley |
| 4,123,131 | A | | 10/1978 | Pearce, Jr. et al. |
| 4,152,643 | A | | 5/1979 | Schweitzer |
| 4,154,993 | A | | 5/1979 | Kumbera et al. |
| 4,161,012 | A | | 7/1979 | Cunningham |
| 4,163,118 | A | | 7/1979 | Marien et al. |
| 4,186,985 | A | | 2/1980 | Stepniak et al. |
| 4,203,017 | A | | 5/1980 | Lee |
| 4,210,381 | A | | 7/1980 | Borgstrom |
| 4,223,179 | A | | 9/1980 | Lusk et al. |
| 4,260,214 | A | | 4/1981 | Dorn |
| 4,343,356 | A | | 8/1982 | Riggs et al. |
| 4,353,611 | A | | 10/1982 | Siebens et al. |
| 4,354,721 | A | | 10/1982 | Luzzi |
| 4,360,967 | A | | 11/1982 | Luzzi et al. |
| 4,414,812 | A | * | 11/1983 | Parry ..... 60/641.14 |
| 4,443,054 | A | | 4/1984 | Ezawa et al. |
| 4,484,169 | A | | 11/1984 | Nishikawa |
| 4,500,935 | A | | 2/1985 | Tsuruta et al. |
| 4,508,413 | A | | 4/1985 | Bailey |
| 4,568,804 | A | | 2/1986 | Luehring |
| 4,600,260 | A | | 7/1986 | Stepniak et al. |
| 4,626,755 | A | | 12/1986 | Butcher et al. |
| 4,638,403 | A | | 1/1987 | Amano et al. |
| 4,688,013 | A | | 8/1987 | Nishikawa |
| 4,700,258 | A | | 10/1987 | Farmer |
| 4,715,104 | A | | 12/1987 | Schoenwetter et al. |
| 4,722,694 | A | | 2/1988 | Makal et al. |
| 4,767,894 | A | | 8/1988 | Schombourg |
| 4,767,941 | A | | 8/1988 | Brand et al. |
| 4,779,341 | A | | 10/1988 | Roscizewski |
| 4,793,637 | A | | 12/1988 | Laipply et al. |
| 4,799,895 | A | | 1/1989 | Borgstrom |
| 4,820,183 | A | | 4/1989 | Knapp et al. |
| 4,822,291 | A | | 4/1989 | Cunningham |
| 4,834,677 | A | | 5/1989 | Archang |
| 4,857,021 | A | | 8/1989 | Boliver et al. |
| 4,863,392 | A | | 9/1989 | Borgstrom et al. |
| 4,867,687 | A | | 9/1989 | Williams et al. |
| 4,871,888 | A | | 10/1989 | Bestel |
| 4,891,016 | A | | 1/1990 | Luzzi et al. |
| 4,911,655 | A | | 3/1990 | Pinyan et al. |
| 4,946,393 | A | | 8/1990 | Borgstrom |
| 4,955,823 | A | | 9/1990 | Luzzi |
| 4,972,049 | A | | 11/1990 | Muench |
| 4,982,059 | A | | 1/1991 | Bestel |
| 5,025,121 | A | | 6/1991 | Allen et al. |
| 5,045,656 | A | | 9/1991 | Kojima |
| 5,045,968 | A | | 9/1991 | Suzuyama et al. |
| 5,114,357 | A | | 5/1992 | Luzzi |
| 5,128,824 | A | | 7/1992 | Yaworski et al. |
| 5,130,495 | A | | 7/1992 | Thompson |
| 5,175,403 | A | | 12/1992 | Hamm et al. |
| 5,213,517 | A | | 5/1993 | Kerek et al. |
| 5,221,220 | A | | 6/1993 | Roscizewski |
| 5,230,142 | A | | 7/1993 | Roscizewski |
| 5,230,640 | A | | 7/1993 | Tardif |
| 5,248,263 | A | | 9/1993 | Sakurai et al. |
| 5,266,041 | A | | 11/1993 | De Luca |
| 5,277,605 | A | | 1/1994 | Roscizewski et al. |
| 5,356,304 | A | | 10/1994 | Colleran |
| 5,358,420 | A | | 10/1994 | Cairns et al. |
| 5,359,163 | A | | 10/1994 | Woodard |
| 5,393,240 | A | | 2/1995 | Makal et al. |
| 5,427,538 | A | | 6/1995 | Knapp et al. |
| 5,429,519 | A | | 7/1995 | Murakami et al. |
| 5,433,622 | A | | 7/1995 | Galambos |
| 5,435,747 | A | | 7/1995 | Franckx et al. |
| 5,445,533 | A | * | 8/1995 | Roscizewski et al. ..... 439/184 |
| 5,468,164 | A | | 11/1995 | Demissy |
| 5,492,487 | A | | 2/1996 | Cairns et al. |
| 5,525,069 | A | | 6/1996 | Roscizewski et al. |
| 5,589,671 | A | | 12/1996 | Hackbarth et al. |
| 5,619,021 | A | | 4/1997 | Yamamoto et al. |
| 5,641,310 | A | | 6/1997 | Tiberio, Jr. |
| 5,655,921 | A | | 8/1997 | Makal |
| 5,661,280 | A | | 8/1997 | Kuss et al. |
| 5,667,060 | A | | 9/1997 | Luzzi |
| 5,717,185 | A | | 2/1998 | Smith |
| 5,736,705 | A | | 4/1998 | Bestel et al. |
| 5,737,874 | A | | 4/1998 | Sipos et al. |
| 5,747,765 | A | | 5/1998 | Bestel et al. |
| 5,747,766 | A | | 5/1998 | Waino et al. |
| 5,766,030 | A | | 6/1998 | Suzuki |
| 5,766,517 | A | | 6/1998 | Goedde et al. |
| 5,795,180 | A | | 8/1998 | Siebens |
| 5,808,258 | A | | 9/1998 | Luzzi |
| 5,816,835 | A | | 10/1998 | Meszaros |
| 5,846,093 | A | | 12/1998 | Muench et al. |
| 5,857,862 | A | | 1/1999 | Muench et al. |
| 5,864,942 | A | | 2/1999 | Luzzi |
| 5,912,604 | A | | 6/1999 | Harvey et al. |
| 5,917,167 | A | | 6/1999 | Bestel |
| 5,936,825 | A | | 8/1999 | DuPont |
| 5,957,712 | A | | 9/1999 | Stepniak |
| 6,022,247 | A | | 2/2000 | Akiyama et al. |
| 6,040,538 | A | | 3/2000 | French et al. |
| 6,042,407 | A | | 3/2000 | Scull et al. |
| 6,130,394 | A | | 10/2000 | Hogl |
| 6,168,447 | B1 | | 1/2001 | Stepniak et al. |
| 6,213,799 | B1 | | 4/2001 | Jazowski et al. |
| 6,220,888 | B1 | | 4/2001 | Correa |
| 6,227,908 | B1 | | 5/2001 | Aumeier |
| 6,250,950 | B1 | | 6/2001 | Pallai |
| 6,280,659 | B1 | | 8/2001 | Sundin |
| 6,332,785 | B1 | | 12/2001 | Muench, Jr. et al. |
| 6,338,637 | B1 | | 1/2002 | Muench, Jr. et al. |
| 6,362,445 | B1 | | 3/2002 | Mearchland et al. |
| 6,364,216 | B1 | | 4/2002 | Martin |
| 6,416,338 | B1 | | 7/2002 | Berlovan |
| 6,453,776 | B1 | * | 9/2002 | Beattie et al. ..... 81/53.1 |
| 6,504,103 | B1 | | 1/2003 | Meyer et al. |
| 6,517,366 | B2 | | 2/2003 | Bertini et al. |
| 6,520,795 | B1 | | 2/2003 | Jazowski |
| 6,538,312 | B1 | | 3/2003 | Peterson et al. |
| 6,542,056 | B2 | | 4/2003 | Nerstron et al. |
| 6,566,996 | B1 | | 5/2003 | Douglass et al. |
| 6,585,531 | B1 | | 7/2003 | Stepniak et al. |
| 6,674,159 | B1 | | 1/2004 | Peterson et al. |
| 6,689,947 | B2 | | 2/2004 | Ludwig |
| 6,705,898 | B2 | | 3/2004 | Pechstein et al. |
| 6,709,294 | B1 | | 3/2004 | Cohen et al. |
| 6,733,322 | B2 | | 5/2004 | Boemmel et al. |
| 6,744,255 | B1 | | 6/2004 | Steinbrecher et al. |
| 6,790,063 | B2 | | 9/2004 | Jazowski et al. |
| 6,796,820 | B2 | | 9/2004 | Jazowski et al. |
| 6,809,413 | B1 | | 10/2004 | Peterson et al. |
| 6,811,418 | B2 | | 11/2004 | Jazowski et al. |
| 6,830,475 | B2 | | 12/2004 | Jazowski et al. |

| | | | | |
|---|---|---|---|---|
| 6,843,685 | B1 | 1/2005 | Borgstrom et al. | |
| 6,905,356 | B2 | 6/2005 | Jazowski et al. | |
| 6,936,947 | B1 | 8/2005 | Leijon et al. | |
| 6,939,151 | B2 | 9/2005 | Borgstrom et al. | |
| 6,984,791 | B1 | 1/2006 | Meyer et al. | |
| 7,018,236 | B2 | 3/2006 | Nishio et al. | |
| 7,019,606 | B2 | 3/2006 | Williams et al. | |
| 7,044,760 | B2 | 5/2006 | Borgstrom et al. | |
| 7,044,769 | B2 | 5/2006 | Zhao et al. | |
| 7,050,278 | B2 | 5/2006 | Poulsen | |
| 7,059,879 | B2 | 6/2006 | Krause et al. | |
| 7,077,672 | B2 | 7/2006 | Krause et al. | |
| 7,079,367 | B1 | 7/2006 | Liljestrand | |
| 7,083,450 | B1 | 8/2006 | Hughes | |
| 7,104,822 | B2 | 9/2006 | Jazowski et al. | |
| 7,104,823 | B2 | 9/2006 | Jazowski et al. | |
| 7,108,568 | B2 | 9/2006 | Jazowski et al. | |
| 7,134,889 | B2 * | 11/2006 | Hughes et al. | 439/184 |
| 7,150,098 | B2 | 12/2006 | Borgstrom et al. | |
| 7,168,983 | B2 | 1/2007 | Graf et al. | |
| 7,170,004 | B2 | 1/2007 | Gramespacher et al. | |
| 7,182,647 | B2 | 2/2007 | Muench et al. | |
| 7,212,389 | B2 | 5/2007 | Hughes | |
| 7,216,426 | B2 | 5/2007 | Borgstrom et al. | |
| 7,234,980 | B2 | 6/2007 | Jazowski et al. | |
| 7,247,061 | B2 | 7/2007 | Hoxha et al. | |
| 7,247,266 | B2 | 7/2007 | Bolcar | |
| 7,258,585 | B2 | 8/2007 | Hughes et al. | |
| 7,278,889 | B2 | 10/2007 | Muench et al. | |
| 7,341,468 | B2 * | 3/2008 | Hughes et al. | 439/185 |
| 2001/0008810 | A1 | 7/2001 | George et al. | |
| 2002/0055290 | A1 | 5/2002 | Jazowski et al. | |
| 2003/0228779 | A1 | 12/2003 | Jazowski et al. | |
| 2004/0121657 | A1 | 6/2004 | Muench et al. | |
| 2005/0208808 | A1 | 9/2005 | Jazowski et al. | |
| 2005/0212629 | A1 | 9/2005 | Williams et al. | |
| 2005/0260876 | A1 | 11/2005 | Krause et al. | |
| 2006/0110983 | A1 | 5/2006 | Muench et al. | |
| 2006/0160388 | A1 | 7/2006 | Hughes et al. | |
| 2006/0216992 | A1 | 9/2006 | Hughes et al. | |
| 2007/0026713 | A1 | 2/2007 | Hughes et al. | |
| 2007/0026714 | A1 | 2/2007 | Hughes et al. | |
| 2007/0032110 | A1 | 2/2007 | Hughes et al. | |
| 2007/0097601 | A1 | 5/2007 | Hughes et al. | |
| 2007/0108164 | A1 | 5/2007 | Muench et al. | |

FOREIGN PATENT DOCUMENTS

| | | | |
|---|---|---|---|
| DE | 3521365 | | 2/1987 |
| DE | 19906972 | A1 | 2/1999 |
| EP | 062494 | | 11/1994 |
| EP | 0782162 | A2 | 7/1997 |
| EP | 0957496 | | 11/1999 |
| FR | 2508729 | | 12/1982 |
| GB | 105227 | | 2/1918 |
| GB | 2254493 | | 10/1992 |
| JP | S62-198677 | | 12/1987 |
| JP | S63-93081 | | 6/1988 |
| JP | H1-175181 | | 7/1989 |
| JP | H3-88279 | | 9/1991 |
| JP | H4-54164 | | 5/1992 |
| WO | WO 00/41199 | | 7/2000 |

OTHER PUBLICATIONS

U.S. Appl. No. 11/738,995, Steinbrecher et. al.
U.S. Appl. No. 11/738,948, Hughes et. al.
U.S. Appl. No. 11/738,941, Hughes et. al.
U.S. Appl. No. 11/688,673, Hughes et. al.
U.S. Appl. No. 11/688,648, Hughes et. al.
U.S. Appl. No. 11/677,703, Hughes et. al.
U.S. Appl. No. 11/676,861, Hughes et. al.
Loadbreak Apparatus Connectors Service Information 500-26, Cooper Power Systems, May 2003, Waukesha, WI.
Deadbreak Apparatus Connectors Electrical Apparatus, Cooper Power Systems, Jul. 1999, Marketing Material.
Link-Op 600A Operable Connector System, Marketing Material.
Installation Instructions, 650LK-B Link Operable Connector System (Bolted) May 1, 1989.
G&W Electric Co.; "Breakthrough in Switching Technology; Solid Dielectric Switchgear"; Oct. 2001; Blue Island, IL. cited by other.
Cooper Power Systems; "Padmounted Switchgear; Type RVAC, Vacuum-Break Switch, Oil-Insulated or SF.sub.6-Insulated; Electrical Apparatus 285-50"; Jul. 1998. cited by other.
Cooper Power Systems; "Padmounted Switchgear; Type MOST Oil Switch; Electrical Apparatus 285-20"; Jul. 1998. cited by other.
Cooper Power Systems; "Molded Rubber Products; 600 A 35 kV Class Bol-T.TM. Deadbreak Connector; Electrical Apparatus 600-50"; Jan. 1990. cited by other.
Cooper Power Systems; "Padmounted Switchgear; Kyle.RTM. Type VFI Vacuum Fault Interrupter; Electrical Apparatus 285-10", Jan. 1998. cited by other.
"Loadbreak Appatus Connectors, 200 A 25kV Class—Expanded Range Loadbreak Elbow Connector, Electrical Apparatus 500-28"; Cooper Power Systems; pp. 1-4; (Jan. 2004). cited by other.
Kevin Fox, "The Cooper Posi-Break.TM. Solution to Separable Connector Switching Problems at Wisconsin Electric Power Company," Component Products, Bulletin No. 98065, copyright 1998 Cooper Power Systems, MI Oct. 1998 5M, 2 total pages. cited by other.
"The Cooper Posi-Break.TM., Elbow and Cap, Engineered Solution Increases Strike Distance and Improves Reliability," copyright 1998 Cooper Power Systems, Inc., Bulletin 98014, MI 398/15M, 6 total pages. cited by other.
Loadbreak Apparatus Connectors, "200 A 25 kV Class Loadbreak Bushing Insert," Service Information 500-26, Cooper Power Systems, May 2003, pp. 1-2. cited by other.
Loadbreak Apparatus Connectors, "200 A kV Class Cooper Posi-Break.TM. Expanded Range Loadbreak Elbow Connector," Service Information 500-29, Cooper Power Systems, Jan. 2004, pp. 1-4. cited by other.
Product Brief, "Latched Elbow Indicator," Cooper Power Systems, Bulletin 94014, Apr. 1994, 1 total page. cited by other.
"Stick-OPerable 600-Amp Connector Systems," *Elastimold, Amerace Corporation*, Feb. 1984, 11 pages.
"Molded Rubber Products, 600 A 15 kV Class T-OP™ II Deadbreak Connector Electrical Apparatus 600-12," *Cooper Power Systems*, Jul. 2005, pp. 1-4.
"Molded Rubber Products, 600 A 15 and 25 kV Deadbreak Accessories, Tools, Replacement Parts Electrical Apparatus 600-46"; *Cooper Power Systems*, Jul. 1997, pp. 1-4.
"Molded Rubber Products, 600 A 25 kV Class BT-TAP™ Deadbreak Connecor Electrical Apparatus, 600-35," *Cooper Power Systems*, Mar. 2003, pp. 1-5.
"Deadbreak Apparatus Connectors, 600 A 15/25 kV Class Bol-T™ Deadbreak Connector Electrical Apparatus 600-10," *Cooper Power Systems*, Aug. 2002, 6 pages.
"Deadbreak Apparatus Connector, 600 A 25 kV Class Bushing Adapter for T-OP™ II Connector Systems (including LRTP and Bushing Extender) Electrical Appparatus 600-38," *Cooper Power Systems*, Jun. 1997, pp. 1-4.
"Loadbreak Apparatus Connectors, 200 A 15 kV Class Loadbreak Bushing Insert 500-12," *Cooper Power Systems*, Nov. 1995, pp. 1-2.
"T-OP™ II: How Many Sticks Does It Take To Operate Your 600 Amp Terminator System?," *Cooper Power Systems*, Jul. 1994, 4 pages.
"Installation & Operation Instructions 168ALR, Access Port Loadbreak Elbow Connectors"; *Elastimold IS-168ALR* (*Rev C*); pp. 1-5; (Feb. 1, 1994).
"Operating Instructions 200TC-2"; *EIastimold IS-200TC* (*Rev-A*); pp. 1-2; (Feb. 26, 1995).
"Surge Arresters"; *Elastimold Catalog*; pp. 26-27; (2001).
"Surge Arresters, Metal Oxide Varistor elbow (M.O.V.E.™) Surge Arrester Electrical Apparatus 235-65"; *Cooper Power Systems*; pp. 1-4; Dec. 2003.
"Surge Arresters, Metal Oxide Elbow Surge Arrester Electrical Apparatus 235-65"; *Cooper Power Systems*; pp. 1-4; Jan. 1991.

"Surge Arresters, Metal Oxide Varistor (MOV) Parking Stand Surge Arrester Electrical Apparatus 235-68"; *Cooper Power Systems*; pp. 1-3; Apr. 2002.
"INJPLUG35, 35 kV Amp Loadbreak Injection Plug Operating and Installation Instructions"; *Cooper Power Systems*; p. 1; (Sep. 2002).
"Loadbreak Apparatus Connectors, 200 A 15 kV Class Loadbreak Elbow Connector, Electrical Apparatus 500-10"; *Cooper Power Systems*; pp. 1-4; (Feb. 2004).
"Loadbreak Apparatus Connectors, 200 A 15 kV and 25 kV Class Elbow Installation Instructions, Service Information S500-10-1"; *Cooper Power Systems*; pp. 1-4; (Feb. 2001).
"Loadbreak Apparatus Connectors, 200 A 15kV Class Loadbreak Bushing Insert 500-12"; *Cooper Power Systems*; pp. 1-2; (Nov. 1995).
"Loadbreak Apparatus Connectors, 200 A 15kV Class Loadbreak Rotatable Feedthru Insert; Electrical Apparatus 500-13"; *Cooper Power Systems*; pp. 1-2; (Apr. 2001).
"Loadbreak Apparatus Connectors, 200 A 25 kV Class—Expanded Range Loadbreak Elbow Connector, Electrical Apparatus 500-28"; *Cooper Power Systems*; pp. 1-4; (Jan. 2004).
"Loadbreak Apparatus Connectors, 200 A 25 kV Class Rotatable Feedthru Insert, Electrical Apparatus 500-30"; *Cooper Power Systems*; pp. 1-2; (Jun. 1999).
"Loadbreak Apparatus Connectors, 200 A 35 kV Class Three-Phase Loadbreak Injection Elbow Installation Instructions, Service Information S500-55-2"; *Cooper Power Systems*; pp. 1-6; (Apr. 1999).
Cooper Power Systems, *Deadbreak Apparatus Connectors*, "600 A 15/25 kV Clas Bol-T™ Deadbreak Connector", Electrical Apparatus 600-30, pp. 1-6, Feb. 2003.
Cooper Power Systems, *Deadbreak Apparatus Connectors*, "600 A 15/25 kV Class PUSH-OP® Deadbreak Connector", Electrical Apparatus 600-33, pp. 1-4, Nov. 2004.
Cooper Power systems, *Molded Rubber Products*, "600 A 15/25 kV Class T-OP™ II Deadbreak Connector", Electrical Apparatus 600-32, pp. 1-4, Jul. 2005.
Cooper Power Systems, *OEM Equipment*, "Four-Position Sectionalizing Loadbreak Switches", Electrical Apparatus 800-64, pp. 1-8, Dec. 2003.

* cited by examiner

SEPARABLE LOADBREAK CONNECTOR FOR MAKING OR BREAKING AN ENERGIZED CONNECTION IN A POWER DISTRIBUTION NETWORK

BACKGROUND OF THE INVENTION

This invention relates generally to cable connectors for electric power systems, and more particularly to separable insulated loadbreak connector systems for use with cable distribution systems.

Electrical power is typically transmitted from substations through cables which interconnect other cables and electrical apparatus in a power distribution network. The cables are typically terminated on bushings that may pass through walls of metal encased equipment such as capacitors, transformers or switchgear.

Separable loadbreak connectors allow connection or disconnection of the cables to the electrical apparatus for service, repair, or expansion of an electrical distribution system. Such connectors typically include a contact tube surrounded by elastomeric insulation and a semiconductive ground shield. A contact piston is located in the contact tube, and a female contact having contact fingers is coupled to the piston. An arc interrupter, gas trap and arc-shield are also mounted to the contact tube. The female contact fingers are matably engaged with an energized male contact of a mating bushing, typically an elbow connector, to connect or disconnect the power cables from the apparatus. The piston is movable within the contact tube to hasten the closure of the male and female contacts and thus extinguish any arc created as they are engaged.

Such connectors are operable in "loadmake", "loadbreak", and "fault closure" conditions. Fault closure involves the joinder of male and female contact elements, one energized and the other engaged with a load having a fault, such as a short circuit condition. In fault closure conditions, a substantial arcing occurs between the male and female contact elements as they approach one another and until they are joined in mechanical and electrical engagement. Such arcing causes air in the connector to expand rapidly accelerating the piston. A rigid piston stop is typically provided in the contact tube to limit movement of the piston as it is driven forward during fault closure conditions toward the mating contact.

It has been observed, however, that sufficient energy can be generated that rapidly expands the air present in the connector during a fault-close operation that slowing or stopping the piston using a typical piston stop cannot be achieved in the length of travel available. If the piston cannot be prevented from accelerating to a high speed or cannot be slowed prior to engaging the piston stop, the piston may exit the bushing leading to uncontrolled arcing and fault to ground.

DETAILED DESCRIPTION OF THE INVENTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
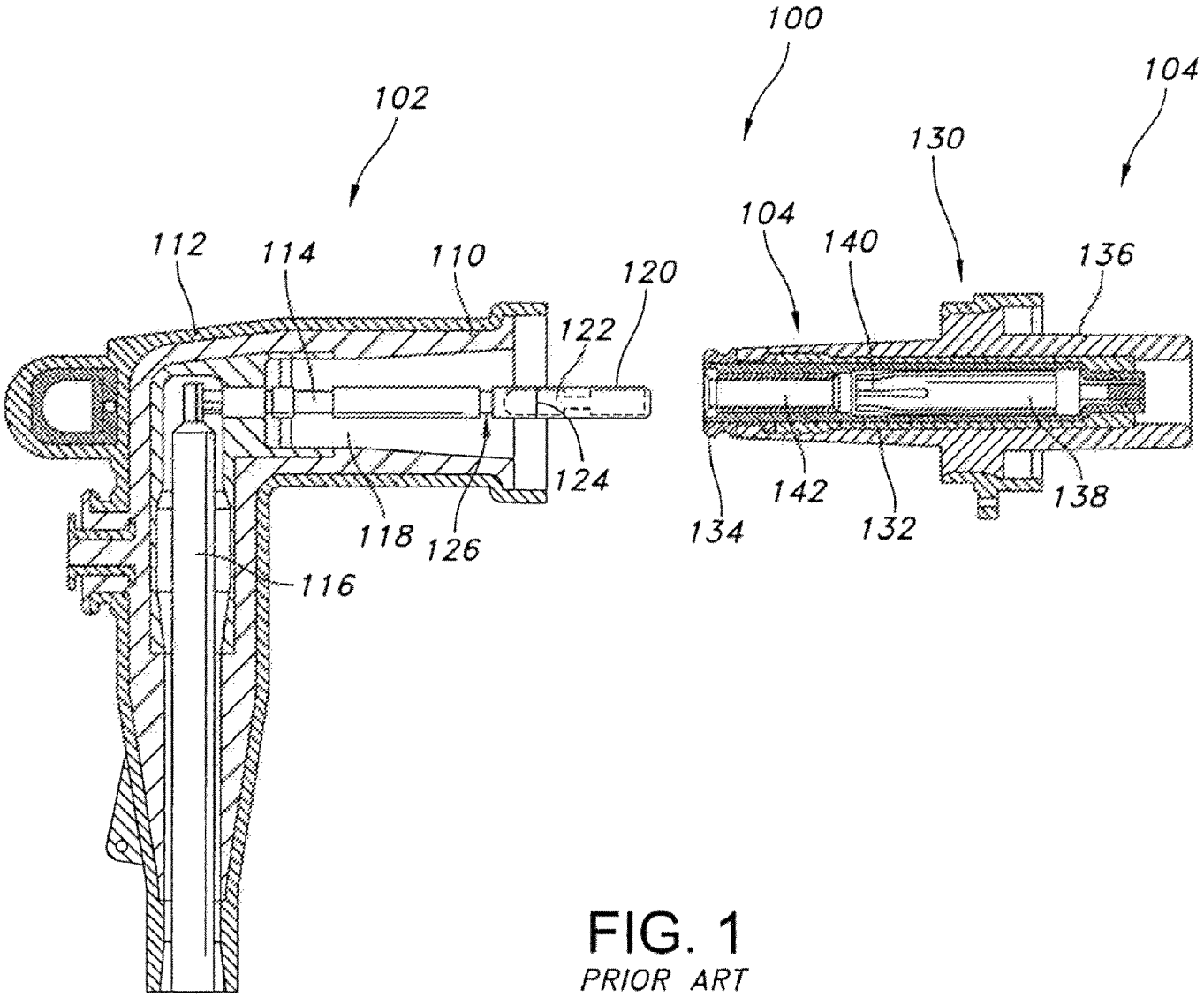
FIG. 1 PRIOR ART
FIG. 1 is a longitudinal cross-sectional view of a known separable loadbreak connector system.

FIG. 1 is a longitudinal cross-sectional view of a separable loadbreak connector system 100, the type of which may be employed with a connector according to the present invention, while avoiding reliability issues of known separable connectors as explained below.

As shown in FIG. 1, the system 100 includes a male connector 102 and a female connector 104 for making or breaking an energized connection in a power distribution network. The female connector 104 may be, for example, a bushing insert or connector connected to an electrical apparatus such as a capacitor, a transformer, or switchgear for connection to the power distribution network, and the male connector 102, may be, for example, an elbow connector, electrically connected to a power distribution network via a cable (not shown). The male and female connectors 102, 104 respectively engage and disengage one another to achieve electrical connection or disconnection to and from the power distribution network.

While the male connector 102 is illustrated as an elbow connector in FIG. 1, and while the female connector 104 is illustrated as a bushing insert, it is contemplated that the male and female connectors may be of other types and configurations in other embodiments. The description and figures set forth herein are set forth for illustrative purposes only, and the illustrated embodiments are but one exemplary configuration embodying the inventive concepts of the present invention.

In an exemplary embodiment, and as shown in FIG. 1, the male connector 102 may include an elastomeric housing 110 of a material such as EPDM (ethylene-propylene-dien-emonomer) rubber which is provided on its outer surface with a conductive shield layer 112 which is connected to electrical ground. One end of a male contact element or probe 114, of a material such as copper, extends from a conductor contact 116 within the housing 110 into a cup shaped recess 118 of the housing 110. An arc follower 120 of ablative material, such as cetal co-polymer resin loaded with finely divided melamine in one example, extends from an opposite end of the male contact element 114. The ablative material may be injection molded on an epoxy bonded glass fiber reinforcing pin 122. A recess 124 is provided at the junction between metal rod 114 and arc follower 120. An aperture 126 is provided through the exposed end of rod 114 for the purpose of assembly.

The female connector 104 may be a bushing insert composed of a shield assembly 130 having an elongated body including an inner rigid, metallic, electrically conductive sleeve or contact tube 132 having a non-conductive nose piece 134 secured to one end of the contact tube 132, and elastomeric insulating material 136 surrounding and bonded to the outer surface of the contact tube 132 and a portion of the nose piece 134. The female connector 104 may be electrically and mechanically mounted to a bushing well (not shown) disposed on the enclosure of a transformer or other electrical equipment.

A contact assembly including a female contact 138 having deflectable contact fingers 140 is positioned within the contact tube 132, and an arc interrupter 142 is provided proximate the female contact 138.

The male and female connectors 102, 104 are operable or matable during "loadmake", "loadbreak", and "fault closure" conditions. Loadmake conditions occur when the one of the contact elements, such as the male contact element 114 is energized and the other of the contact elements, such as the female contact element 138 is engaged with a normal load. An arc of moderate intensity is struck between the contact elements 114, 138 as they approach one another and until joinder under loadmake conditions. Loadbreak conditions occur when the mated male and female contact elements 114, 138 are separated when energized and supplying power to a normal load. Moderate intensity arcing again occurs between the contact elements 114, 138 from the point of separation thereof until they are somewhat removed from one another. Fault closure conditions occur when the male and female contact elements 114, 138 are mated with one of the contacts being energized and the other being engaged with a load having a fault, such as a short circuit condition. Substantial arcing occurs between the contact elements 114, 138 in fault closure conditions as the contact elements approach one another they are joined. In accordance with known connectors, arc-quenching gas is employed to accelerate the female contact 138 in the direction of the male contact element 140 as the connectors 102, 104 are engaged, thus minimizing arcing time and hazardous conditions.

Figure 2:
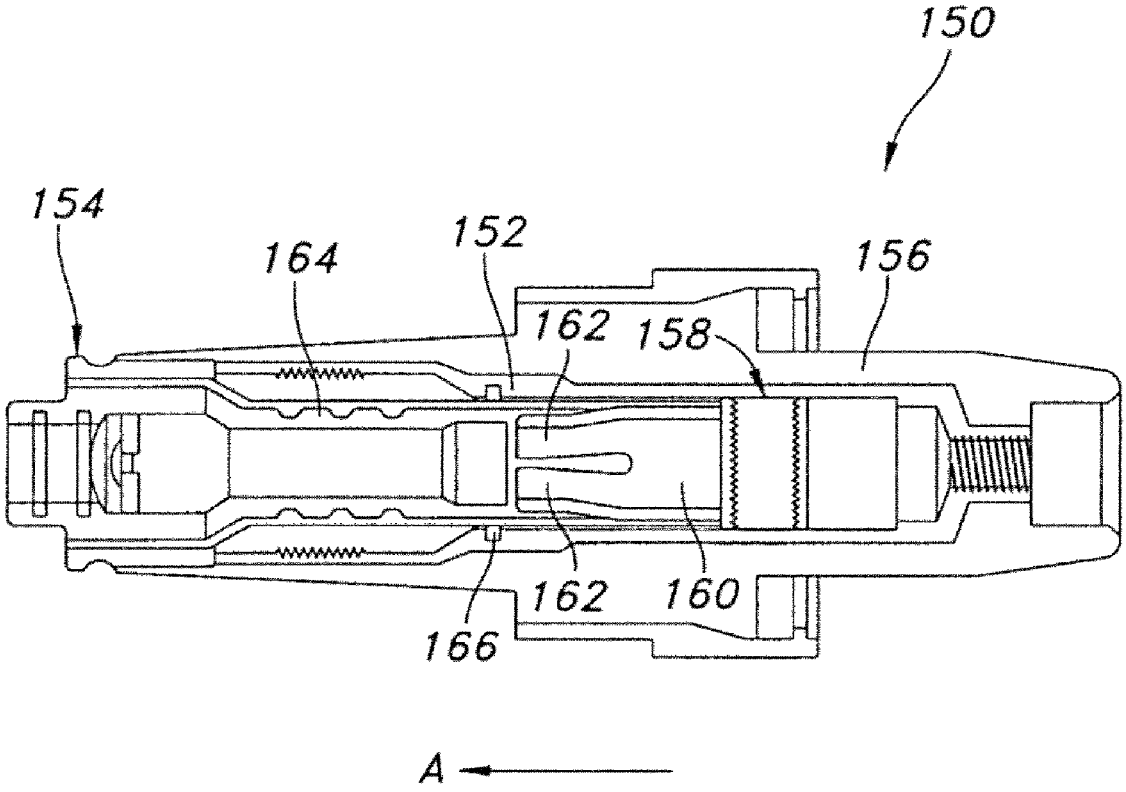
FIG. 2 PRIOR ART
FIG. 2 is an enlarged cross-sectional view of a known female contact connector that may be used in the system shown in FIG. 1.

FIG. 2 illustrates a typical female connector 150 that may be used in the electrical system 100 in lieu of the female connector 104 shown in FIG. 1. Like the connector 104, the female connector 150 includes an elongated body including an inner rigid, metallic, electrically conductive sleeve or contact tube 152 having a non-conductive nose piece 154 secured to one end of the contact tube 152, and elastomeric insulating material 156 surrounding and bonded to the outer surface of the contact tube 152 and a portion of the nose piece 154.

A contact assembly includes a piston 158 and a female contact element 160 having deflectable contact fingers 162 is positioned within the contact tube 152 and an arc interrupter 164 provided proximate the female contact 160. The piston 158, the female contact element 160, and the arc interrupter 164 are movable or displaceable along a longitudinal axis of the connector 150 in the direction of arrow A toward the male contact element 114 (FIG. 1) during a fault closure condition. To prevent movement of the female contact 160 beyond a predetermined amount in the fault closure condition, a stop ring 166 is provided, typically fabricated from a hardened steel or other rigid material. As previously mentioned, however, the considerable force that may result when the piston 158 impacts the stop ring 166 can lead to fault closure failure and undesirable operating conditions if the impact force is sufficient to separate the female contact 160 from the contact tube 150. Additionally, the reliability of the fault closure of the connector 150 is dependent upon a proper installation and position of the stop ring 166 during assembly and installation of the connector, raising reliability issues in the field as the connectors are employed.

Figure 3:
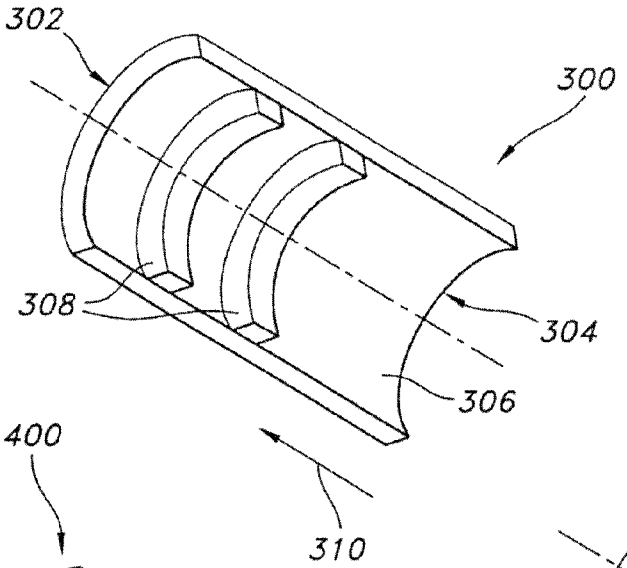
FIG. 3 PRIOR ART
FIG. 3 is a cross sectional view of a female connector according to the present invention in a normal operating position.

FIG. 3 illustrates a portion of a separable loadbreak connector 300 that may be used with female connector 150 (shown in FIG. 2). A contact tube 302 is generally cylindrical and includes a central bore or passage 304 extending axially therethrough. A conductive piston (not shown in FIG. 3) is disposed within passage 304 of contact tube 302. The piston is generally cylindrical or tubular in an exemplary embodiment and conforms to the generally cylindrical shape of internal passage 304.

An inner surface 306 of passage 304 includes one or more circumferential stop rings 308 that extend radially inwardly from surface 306. Stop rings 308 extend into passage 304 of contact tube 302 and faces the piston, and consequently physically obstruct the path of the piston as it is displaced or moved in a sliding manner a direction 310 during fault closure conditions. As the piston moves in direction 310, it will eventually strike at least one of stop rings 308. In an exemplary embodiment, stop rings 308 extend around and along the full circumference of contact tube 302 and faces the piston such that the piston engages at least one of stop rings 308 across its full circumference. In some instances, sufficient pressure from rapidly expanding heated air in passage 304 may be generated so that when the piston abruptly engages stop rings 308, the impact developed is enough to eject contact tube 302 from connector 300 in direction 310.

Figure 4:
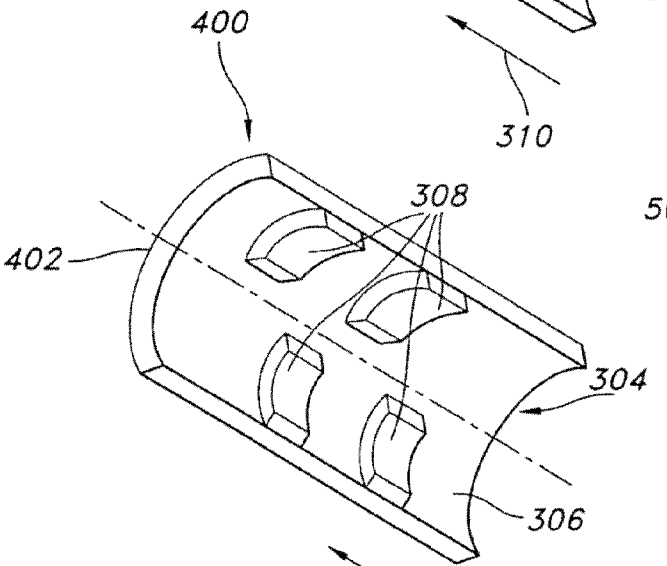
FIG. 4 is a cross sectional view of the female connector shown in FIG. 3 in a fault closure position.

FIG. 4 illustrates a portion of a separable loadbreak connector 400 in accordance with an embodiment of the present invention that may be used with female connector 150 (shown in FIG. 2). In the exemplary embodiment, a contact tube 402 is generally cylindrical and includes a central bore or passage 404 extending axially therethrough. A conductive piston (not shown in FIG. 4) is disposed within passage 404 of contact tube 402. The piston is generally cylindrical or tubular in an exemplary embodiment and conforms to the generally cylindrical shape of internal passage 404.

An inner surface 406 of passage 404 includes one or more stop members 408 that extend radially inwardly from surface 406. Stop members 408 extend into passage 404 of contact tube 402 and face only a portion of the piston, and consequently imparts an unequal force on the face of the piston that tends to cant the piston as it is displaced or moved in a sliding manner a direction 410 during fault closure conditions. As the piston moves in direction 410, a portion of the face of the piston will eventually strike at least one of stop members 408. In the exemplary embodiment, stop members 408 extend only partially around and along the full circumference of contact tube 402 and faces the piston such that the piston engages at least one of stop members 408 across a part of its circumference. The face of the piston tends to cant or tilt within passage 404 after engaging stop members 408. Canting of the piston face while the piston is moving in direction 410 through passage tends to increase the amount of friction between the piston and surface 406. The structure of stop members 408 is configured to cant the piston without abruptly stopping the piston. The increased friction tends to slow the movement of piston while not imparting an impact force to contact tube 402 sufficient to separate contact tube 402 from connector 400.

Figure 5:
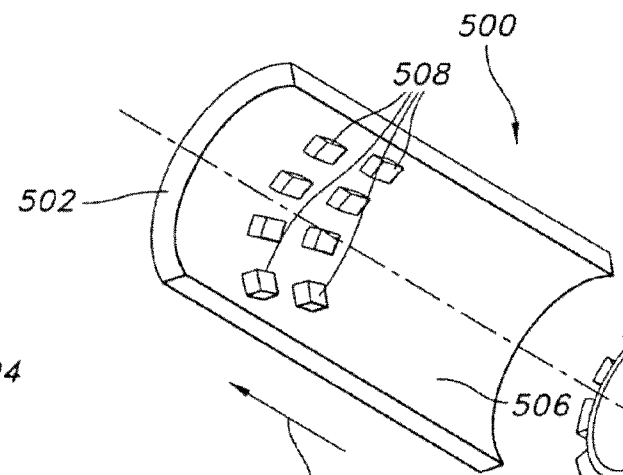
FIG. 5 is an illustration a portion of another exemplary embodiment of a separable loadbreak connector that may be used with the female connector shown in FIG. 2.
Figure 5:
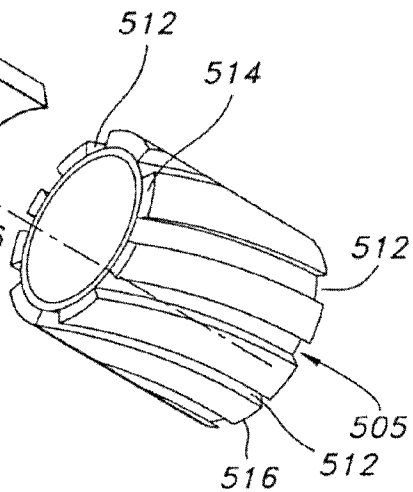

FIG. 5 is an illustration a portion of another exemplary embodiment of a separable loadbreak connector 500 that may be used with female connector 150 (shown in FIG. 2). In the exemplary embodiment, a contact tube 502 is generally cylindrical and includes a central bore or passage 504 extending axially therethrough. A conductive piston 505 is disposed within passage 504 of contact tube 502. The piston is generally cylindrical or tubular in an exemplary embodiment and conforms to the generally cylindrical shape of internal passage 504.

An inner surface 506 of passage 504 includes one or more stop members 508 that extend radially inwardly from surface 506. Stop members 508 extend into passage 504 of contact tube 502 and may extend about the full circumference of surface 506. In one embodiment stop members 508 faces only a portion of the piston, and consequently imparts an unequal force on the face of the piston that tends to cant the piston as it is displaced or moved in a sliding manner a direction 510 during fault closure conditions. As the piston moves in direction 510, a portion of the face of the piston will eventually strike at least one of stop members 508. In the exemplary embodiment, stop members 508 extend only partially around and along the full circumference of contact tube 502 and faces the piston such that the piston engages at least one of stop members 508 across a part of its circumference. The face of the piston tends to cant or tilt within passage 504 after engaging stop members 508. Canting of the piston face while the piston is moving in direction 510 through passage tends to increase the amount of friction between the piston and surface 506.

In an alternative embodiment, stop members 508 extend about the full circumference of surface 506 in one or more axially aligned rows. In the embodiment, piston 505 includes one or more axial grooves 512 circumferentially spaced about piston 505. In the alternative embodiment, the number and spacing of stop members 508 about the circumference of surface 506 is different than the number and spacing of the grooves about an outer circumference of piston 505. In this configuration, grooves 512 on a first side 514 of piston 505 may be nearly aligned with stop members 508 on the same side of surface 506 and grooves 512 on a second side 516 of piston 505 will not be so nearly aligned with stop members 508 on a second corresponding side of surface 506 because of the different number and spacing of grooves 512 and stop members 508. During a fault closure condition, where piston 505 is being urged to move in direction 510 by the expanding gas, grooves 512 will permit at least a portion of the gases to bypass the piston, reducing the force imparted to piston 505. Additionally, because only a portion of stop members 508 and grooves are in axial alignment, stop members 508 will cause piston 505 to cant within contact tube 502. Moreover, the structure of stop members 508 is configured to cant the piston without abruptly stopping the piston. The increased friction tends to slow the movement of piston while reducing the amount of impact force imparted to contact tube 502 to a level that is insufficient to separate contact tube 502 from connector 500.

Figure 6:
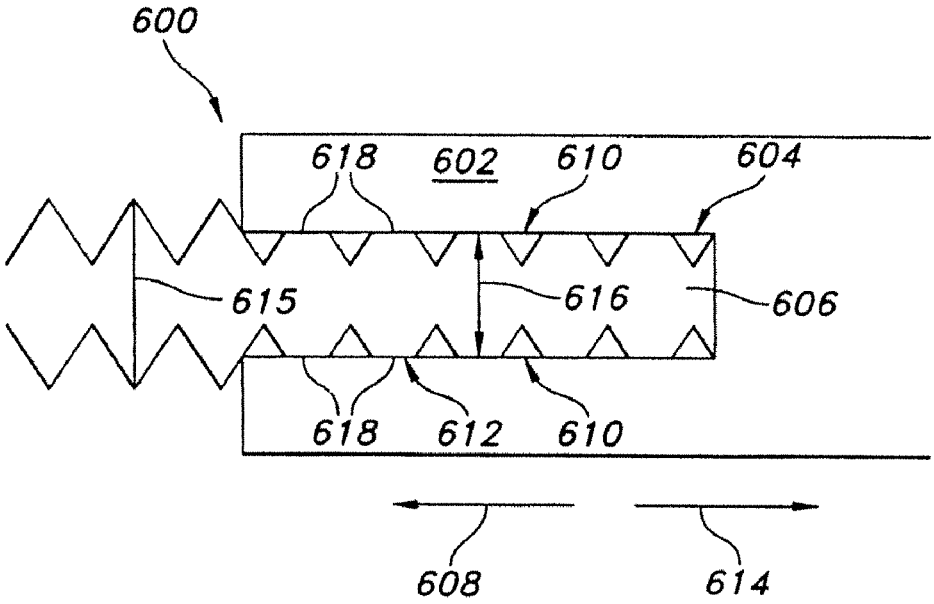
FIG. 6 illustrates a portion of a separable loadbreak connector that may be used with the female connector shown in FIG. 2.

FIG. 6 illustrates a portion of a separable loadbreak connector 600 that may be used with female connector 150 (shown in FIG. 2). In the exemplary embodiment, a contact tube 602 is generally cylindrical and includes a central bore or passage 604 extending axially therethrough. A conductive piston 606 is disposed within passage 604 of contact tube 602. Piston 606 is generally cylindrical or tubular in an exemplary embodiment and conforms to the generally cylindrical shape of the internal passage 604. Piston 606 includes a knurled contour 610, which in FIG. 6 is illustrated greatly enlarged, around an outer circumferential surface 612 to provide a frictional, biting engagement with contact tube 602 to ensure electrical contact therebetween and to provide resistance to movement until a sufficient expanding gas pressure is achieved in a fault closure condition. Once sufficient expanding gas pressure is realized, piston 606 is positionable or slidable within the passage 604 of the contact tube 602 to axially displace piston 606 in a direction 608.

During assembly, piston 606 is inserted axially into passage 604 in a direction 614. An outer diameter 615 of knurled contour 610 is slightly larger than an inner diameter 616 of passage 604. Accordingly, an amount of force is needed to insert piston 606 into passage 604. As piston 606 enters passage 604 peaks 618 of knurled contour 610 are deformed into compliance with inner diameter 616. Such deformation increases a surface area of piston 606 in electrical contact with contact tube 602. However, because peaks 618 are now in conformance with inner diameter 616 and due to the sliding engagement from first contact of peaks 618 with inner diameter 616 to an end of travel position in passage 604, the friction fit between piston 606 and contact tube 602 becomes relatively loose. The relatively loose fit reduces the electrical contact between piston 606 and contact tube 602 and also reduces the frictional fit between piston 606 and contact tube 602. During a fault closure condition electrical contact between piston 606 and contact tube 602 and a tight frictional fit between piston 606 and contact tube 602 are desirable to carry the fault current efficiently and to provide some of the drag that will slow the movement of piston 606. However, because peaks 618 were machined to conform to inner diameter 614 during assembly, peaks 618 provide little drag during movement in direction 608 during a fault closure event.

Figure 7:
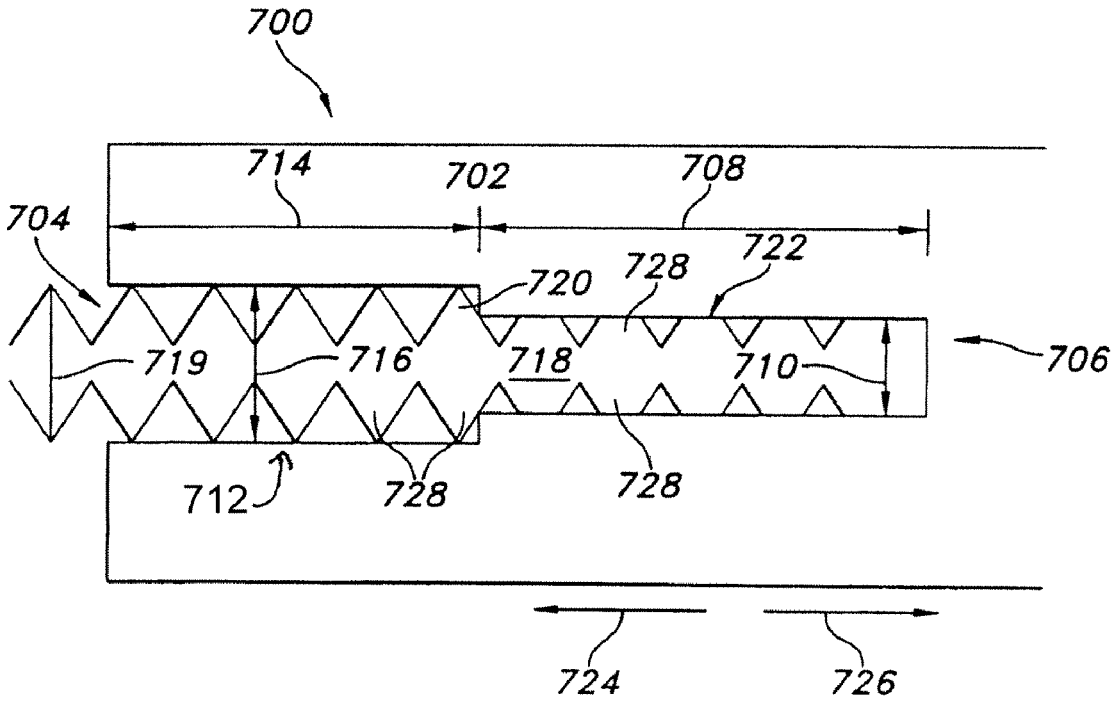
FIG. 7 illustrates a portion of a separable loadbreak connector in accordance with an embodiment of the present invention.

FIG. 7 illustrates a portion of a separable loadbreak connector 600 in accordance with an embodiment of the present invention. In the exemplary embodiment, a contact tube 702 is generally cylindrical and includes a central bore or passage 704 extending axially therethrough. Passage 704 comprises a first axial portion 706 having a first length 708 and a first diameter 710 and a second axial portion 712 having a second length 714 and a second diameter 716. A conductive piston 718 is disposed within passage 704 of contact tube 702. Piston 718 is generally cylindrical or tubular in an exemplary embodiment and conforms to the generally cylindrical shape of the internal passage 704. Piston 718 includes a knurled contour 720, which in FIG. 7 is illustrated greatly enlarged, around an outer circumferential surface 722 to provide a frictional, biting engagement with contact tube 702 to ensure electrical contact therebetween and to provide resistance to movement until a sufficient gas pressure is achieved in a fault closure condition. Once sufficient gas pressure is realized, piston 718 is positionable or slidable within the passage 704 of the contact tube 702 to axially displace piston 718 in a direction 724.

During assembly, piston 718 is inserted axially into passage 704 in a direction 726. An outer diameter 719 of knurled contour 720 is slightly larger than diameters 710 and 716 of passage 704. Accordingly, an amount of force is needed to insert piston 718 into passage 704. As piston 718 enters passage 704 peaks 728 of knurled contour 720 are deformed into compliance with second diameter 716 and then first diameter 710 until piston 718 reaches an end of travel in passage 704. At the end of travel a length of piston 718 corresponding to length 708 is deformed into a diameter substantially equal to first diameter 710 and a length of piston 718 corresponding to length 714 is deformed into a diameter substantially equal to second diameter 716. Such deformation increases a surface area of piston 718 in electrical contact with contact tube 702. However, during assembly peaks 728 are machined into conformance with second diameter 716. Without further insertion of piston 718 into passage 704 corresponding to length 708, the configuration would be similar to that of loadbreak connector 600 shown in FIG. 6 includes the attendant problems described above. However, insertion of piston 718 into passage 704 corresponding to length 708 peaks 728 along length 708 will be made to conform with first diameter 710 to provide a tight friction fit and increased surface area engagement between piston 718 and an inner surface of contact tube 702. Peaks 728 along length 714 maintain an outside diameter substantially equal to second diameter 716. This configuration permits greater electrical contact between piston 718 and contact tube 702 during normal operation and during a fault closure condition resulting in less arcing than in the prior art configuration illustrated in FIG. 6.

Figure 8:
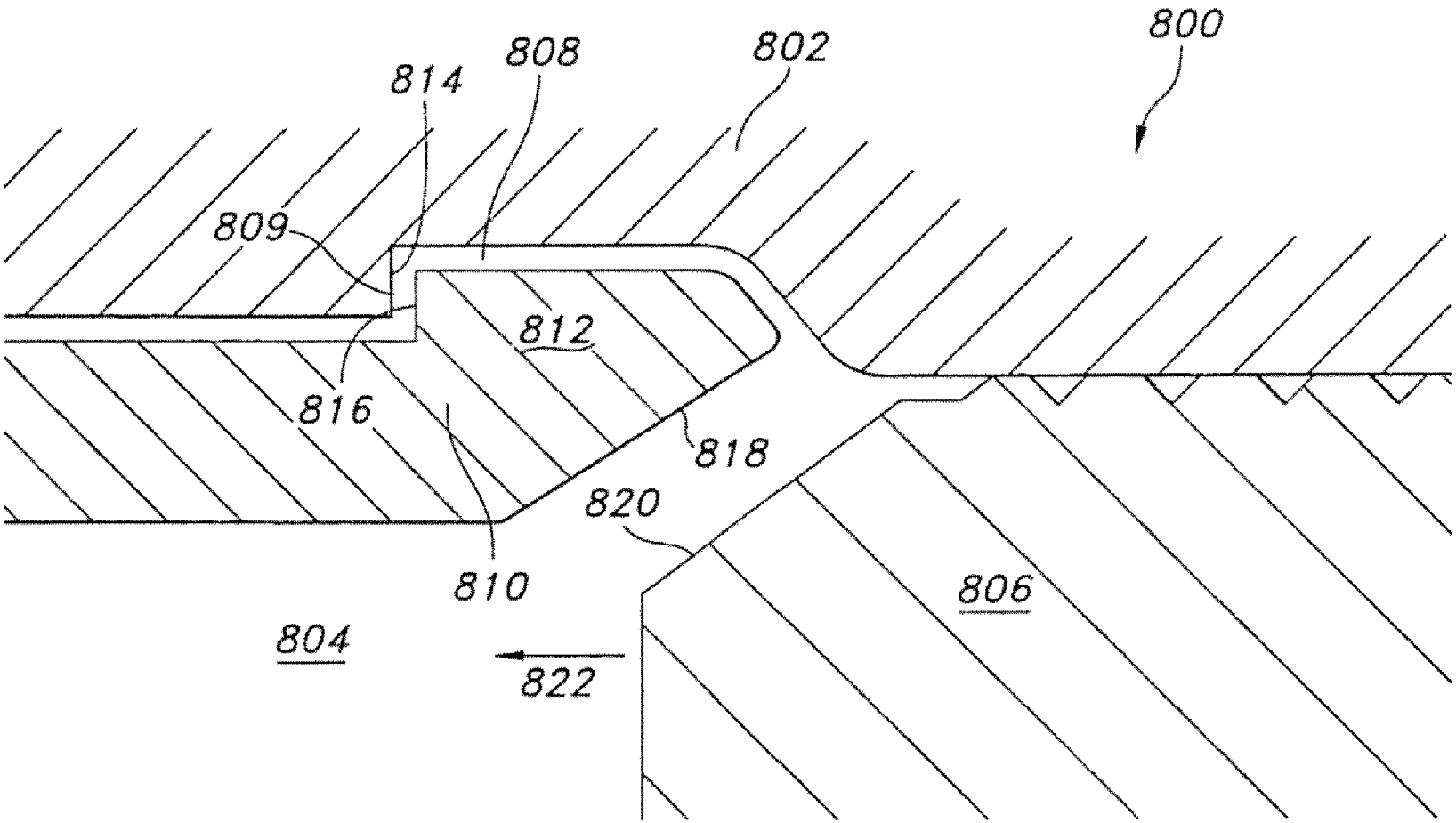
FIG. 8 illustrates an enlarged portion of a separable loadbreak connector in accordance with another embodiment of the present invention.

FIG. 8 illustrates an enlarged portion of a separable loadbreak connector 800 in accordance with an embodiment of the present invention. In the exemplary embodiment, a contact tube 802 is generally cylindrical and includes a central bore or passage 804 extending axially therethrough. A conductive piston 806 is disposed within passage 804 of contact tube 802. Piston 806 is generally cylindrical or tubular in an exemplary embodiment and conforms to the generally cylindrical shape of the internal passage 804. Contact tube 802 includes a radially outwardly extending snap recess 808 comprising a step, shelf, or shoulder 809. A nosepiece 810 is positioned within passage 804 and includes a snap feature 812 that is positioned within passage 804 and extending radially outwardly into snap recess 808. Snap recess 808 and snap feature 812 include mutually complementary annular mating surfaces 814 and 816, respectively.

In the exemplary embodiment, nosepiece 810 includes a first surface 818 facing a complementary second surface 820 formed in piston 806. First and second surfaces 818 and 820 are configured to engage during a fault closure condition. In an alternative embodiment, first surface 818 and second surface 820 are mutually complementary using, for example, but not limited to a convex surface and a concave surface, knurled surfaces, ridged surfaces and other configurations that encourage engagement of surfaces 818 and 820 and facilitate a frictional or interference engagement thereof. During the fault closure condition, piston 806 is urged to move in a direction 822 by expanding gases. When surface 820 engages surface 818, a radially outward force is imparted to snap feature 812 that tends to drive snap feature 812 into snap recess 808. The force from piston 806 is translated thorough snap feature to contact tube 802 through surface 814 on shoulder 809 and surface 816 on snap feature 812, the engagement of which is facilitated by the radially outward force and the motion of piston 806.

It is understood that one or more the foregoing impact dampening features may utilized simultaneously to bring the connector piston to a halt during fault closure conditions. That is, impact dampening may be achieved with combinations of interference members, knurled surfaces, and directional energy translation methods utilized in the contact tube, piston, and associated components.

In an exemplary embodiment the connector 200 is a 600 A, 21.1 kV L-G loadbreak bushing for use with medium voltage switchgear or other electrical apparatus in a power distribution network of above 600V. It is appreciated, however, that the connector concepts described herein could be used in other types of connectors and in other types of distribution systems, such as high voltage systems, in which mechanisms to slow the movement of a connector contact assembly and/or connector piston during a fault closure condition are desirable.

One embodiment of a separable loadbreak connector is disclosed herein that includes a contact tube having an axial passage therethrough and a piston slidably mounted within the axial passage and movable therein during a fault closure condition. The piston is axially movable within the passage with the assistance of an expanding gas during the fault closure condition. The loadbreak connector also includes an interference element spaced about the contact tube that is configured to engage a portion of the piston such that the piston tends to cant within the contact tube when sliding against the interference element.

Optionally, the connector may include an interference element that includes at least one projection extending radially inwardly from the contact tube. The piston may include at least one axial groove configured to align with a portion of the interference element. The interference element may also be fabricated from a plurality of projections extending radially inwardly from the contact tube and the piston may include a plurality of axial grooves at least partially circumferentially off set from the plurality of projections. The at least one axial groove may be configured to release at least a portion of the expanding gas during the fault closure condition. Further, the interference element may include a circumferential projection extending radially inwardly from the contact tube about only a portion of the circumference of the contact tube, for example, the interference element may extend about less than or equal to one half of the circumference of the contact tube. The connector contact tube may also include a first inside diameter extending over a first portion of an axial length of the contact tube and a second inside diameter extending over a second portion of the axial length of the contact tube wherein the second diameter is different than the first diameter. Additionally, the first diameter may be configured to provide a friction fit of the contact tube with the piston and wherein the second diameter is configured to facilitate providing electrical contact between the contact tube and the piston during a fault closure condition.

The piston may include a first knurled surface having a outside diameter approximately equal to the second inside diameter wherein the first knurled surface is configured to engage the first inside diameter and to deform such that an outside diameter of the first knurled surface is approximately equal to the first inside diameter. The piston may also include a second knurled surface having a outside diameter approximately equal to the second inside diameter wherein the second knurled surface is configured to engage the second inside diameter and maintain an outside diameter approximately equal to the second inside diameter.

Optionally, the connector may also include a contact tube with a radially outwardly extending snap recess and a nosepiece attached to the contact tube that includes a snap feature that extends radially outwardly into the snap recess wherein the snap recess and the snap feature each include a mutually complementary annular mating surface. The nosepiece includes a first surface and the piston includes a complementary second surface such that the first and second surfaces are configured to engage each other during a fault closure condition such that a radially outward force is imparted to the nosepiece that tends to drive the snap feature into the snap recess.

An embodiment of a separable loadbreak connector for making or breaking an energized connection in a power distribution network is also disclosed herein. The connector includes a conductive contact tube having an axial passage therethrough. The contact tube includes a first inside diameter extending over a first portion of an axial length of the contact tube and a second inside diameter extending over a second portion of the axial length of the contact tube wherein the second diameter is different than the first diameter. The connector also includes a conductive piston disposed within the passage and displaceable therein with the assistance of an expanding gas. The piston includes a first axial portion in slidable engagement with the first portion of the contact tube and a second axial portion in slidable engagement with the second portion of the contact tube when the connector is assembled.

Optionally, the first diameter is configured to provide a friction fit of the contact tube with the piston and the second diameter is configured to facilitate providing electrical contact between the contact tube and the piston during a fault closure condition. The piston includes a first knurled surface having a outside diameter approximately equal to the second inside diameter wherein the first knurled surface is configured to engage the first inside diameter and to deform such that an outside diameter of the first knurled surface is approximately equal to the first inside diameter. The piston includes a second knurled surface having a outside diameter approximately equal to the second inside diameter wherein the second knurled surface is configured to engage the second inside diameter and maintain an outside diameter approximately equal to the second inside diameter. The length of the first portion may be substantially equal to a length of the second portion.

The connector may further include an interference element spaced about the contact tube and configured to engage a portion of the piston such that the piston tends to cant within the contact tube when sliding against the interference element. The interference element may include at least one projection extending radially inwardly from the contact tube and the piston may include at least one axial groove configured to align with a portion of the interference element. Also optionally, the interference element may be fabricated from a plurality of projections extending radially inwardly from the contact tube and the piston may include a plurality of axial grooves at least partially circumferentially off set from the plurality of projections. At least one of the axial grooves may be configured to release at least a portion of the expanding gas during the fault closure condition.

The interference element may include a circumferential projection extending radially inwardly from the contact tube about only a portion of the circumference of the contact tube, for example, the interference element may extend about less than or equal to one half of the circumference of the contact tube. The contact tube may also include a radially outwardly extending snap recess and a nosepiece attached to the contact tube. The nosepiece may include a snap feature that extends radially outwardly into the snap recess wherein the snap recess and the snap feature each include a mutually complementary annular mating surface. The nosepiece includes a first surface and the piston includes a complementary second surface wherein the first and second surfaces are configured to engage during a fault closure condition such that a radially outward force is imparted to the nosepiece that tends to drive the snap feature into the snap recess.

An embodiment of a separable loadbreak connector to make or break a medium voltage connection with a male contact of a mating connector in a power distribution network is also disclosed herein. The connector includes a conductive contact tube having an axial passage therethrough and a radially outwardly extending snap recess. The connector also includes a nonconductive nosepiece coupled to the contact tube that includes a snap feature extending radially outwardly into the snap recess. The snap recess and the snap feature may each include a substantially mutually complementary annular mating surface wherein the nosepiece includes a first surface, and a conductive piston is disposed within the passage and displaceable therein with the assistance of an expanding gas. The piston includes a second surface complementary to the first surface and the first and second surfaces are configured to engage during a fault closure condition such that a radially outward force is imparted to the nosepiece, the radially outward force tending to drive the snap feature into the snap recess.

Optionally, the connector may also include an interference element spaced about the contact tube that is configured to engage a portion of the piston such that the piston tends to cant within the contact tube when sliding against the interference element. The interference element may include at least one projection that extends radially inwardly from the contact tube and the piston may include at least one axial groove that is configured to align with a portion of the interference element. The interference element may be fabricated from a plurality of projections extending radially inwardly from the contact tube and the piston may include a plurality of axial grooves at least partially circumferentially off set from the plurality of projections. At least one of the axial grooves may be configured to release at least a portion of the expanding gas during the fault closure condition.

The interference element may also include a circumferential projection extending radially inwardly from the contact tube about only a portion of the circumference of the contact tube, for example, the interference element may extend about less than or equal to one half of the circumference of the contact tube. The contact tube may include a first inside diameter extending over a first portion of an axial length of the contact tube and a second inside diameter extending over a second portion of the axial length of the contact tube wherein the second diameter is different than the first diameter. The first diameter may also be configured to provide a friction fit of the contact tube with the piston and wherein the second diameter is configured to facilitate providing electrical contact between the contact tube and the piston during a fault closure condition.

The piston may include a first knurled surface having a outside diameter approximately equal to the second inside diameter that is configured to engage the first inside diameter and to deform such that an outside diameter of the first knurled surface is approximately equal to the first inside diameter. The piston may also include a second knurled surface having a outside diameter approximately equal to the second inside diameter that is configured to engage the second inside diameter and maintain an outside diameter approximately equal to the second inside diameter.

An embodiment of a separable loadbreak connector system is also disclosed herein. The system includes a conductive contact tube including a radially outwardly extending snap recess and an axial passage therethrough. The axial passage includes a first inside diameter extending over a first portion of an axial length of the contact tube and a second inside diameter extending over a second portion of the axial length of the contact tube wherein the second diameter is different than the first diameter. The system also includes a piston that is slidably mounted within the axial passage and is axially movable within the passage with the assistance of an expanding gas during a fault closure condition. The piston includes a first surface. An interference element is spaced about the contact tube and is configured to engage a portion of the piston such that the piston tends to cant within the contact tube when sliding against the interference element. The system also includes a nonconductive nosepiece coupled to the contact tube and including a snap feature extending radially outwardly into the snap recess. The snap recess and the snap feature may each include a mutually complementary annular mating surface. The nosepiece may include a second surface that is complementary to the first surface wherein the first and second surfaces are configured to engage during a fault closure condition such that a radially outward force is imparted to the nosepiece that tends to drive the snap feature into the snap recess.

While the invention has been described in terms of various specific embodiments, those skilled in the art will recognize that the invention can be practiced with modification within the spirit and scope of the claims.

What is claimed is:

1. A separable loadbreak connector for making or breaking an energized connection in a power distribution network, comprising:

a conductive contact tube disposed within said separable loadbreak connector, said contact tube having an axial passage therethrough, said contact tube comprising a first inside diameter extending over a first portion of an axial length of said contact tube, said contact tube comprising a second inside diameter extending over a second portion of the axial length of said contact tube, said second diameter being different than said first diameter; and a conductive piston disposed within the passage and displaceable therein with the assistance of an expanding gas, said piston comprising a first axial portion in slidable engagement with the first portion of said contact tube and a second axial portion in slidable engagement with the second portion of said contact tube when the connector is assembled, wherein said conductive piston is configured to move relative to said conductive contact tube when said separable loadbreak connector is in a fault closure condition, and wherein said piston comprises a first knurled surface having an outside diameter approximately equal to the second inside diameter, said first knurled surface configured to deform to engage said first inside diameter and to deform such that an outside diameter of said first knurled surface is approximately equal to said first inside diameter, and wherein said piston comprises a second knurled surface having an outside diameter approximately equal to the second inside diameter, said second knurled surface configured to engage said second inside diameter and to maintain an outside diameter approximately equal to the second inside diameter.

2. A connector in accordance with claim 1, wherein said first diameter is configured to provide a friction fit of said contact tube with said piston and wherein said second diameter is configured to facilitate providing electrical contact between said contact tube and said piston during a fault closure condition.

3. A connector in accordance with claim 1 wherein a length of the first portion is substantially equal to a length of the second portion.

4. A separable loadbreak connector for making or breaking an energized connection in a power distribution network, comprising:

a contact tube disposed within said separable loadbreak connector, said contact tube having an axial passage therethrough, said contact tube comprising a first inside diameter extending over a first portion of an axial length of said contact tube, and said contact tube comprising a second inside diameter extending over a second portion of the axial length of said contact tube, said second diameter being different than said first diameter; and a piston disposed within the passage, said piston comprising a first knurled surface having an outside diameter approximately equal to the second inside diameter, said first knurled surface configured to deform to engage said first inside diameter such that an outside diameter of said first knurled surface is approximately equal to said first inside diameter, wherein said piston is configured to move relative to said contact tube when said separable loadbreak connector is in a fault closure condition.

5. A connector in accordance with claim 4, wherein said piston comprises a second knurled surface having an outside diameter approximately equal to the second inside diameter, said second knurled surface being configured to engage said second inside diameter.

6. A connector in accordance with claim 4, wherein one of said first diameter and said second diameter is configured to provide a friction fit of said contact tube with said piston and wherein the other one of said first diameter and said second diameter is configured to facilitate providing electrical contact between said contact tube and said piston during a fault closure condition.

7. A connector in accordance with claim 5, wherein said piston is displaceable relative to the passage with the assistance of an expanding gas, said piston comprising a first axial portion on said first knurled surface in slidable engagement with the first portion of said contact tube and a second axial portion on said second knurled surface in slidable engagement with the second portion of said contact tube when the connector is assembled.

8. A connector in accordance with claim 4, wherein a length of the first portion of said contact tube is substantially equal to a length of the second portion of said contact tube.

9. A connector in accordance with claim 4, wherein at least one of said contact tube and said piston comprises a conductive material.

10. A connector in accordance with claim 4, wherein said first diameter is configured to provide a friction fit of said contact tube with said piston and wherein said second diameter is configured to facilitate providing electrical contact between said contact tube and said piston during a fault closure condition.

11. A connector in accordance with claim 4, wherein said piston comprises a first knurled surface having an outside diameter approximately equal to the second inside diameter, said first knurled surface configured to deform to engage said first inside diameter such that an outside diameter of said first knurled surface is approximately equal to said first inside diameter.

12. A connector in accordance with claim 4, wherein a length of the first portion is greater than a length of the second portion.

13. A connector in accordance with claim 4, wherein a length of the first portion is less than a length of the second portion.

* * * * *